United States Patent [19]

Sanden

[11] 3,930,673

[45] Jan. 6, 1976

[54] LOTTERY TICKET

[76] Inventor: Stig Emil Sanden, Ystadnagen 22, S-241 00 Ystad, Sweden

[22] Filed: Aug. 9, 1974

[21] Appl. No.: 496,065

[30] Foreign Application Priority Data

Aug. 28, 1973 Sweden ..... 7311641

[52] U.S. Cl. ..... 283/6; 55/9 E

[51] Int. Cl.[2] ..... B42D 15/00

[58] Field of Search ..... 283/6; 35/9

[56] References Cited

UNITED STATES PATENTS 3,593,443 7/1971 Demetrius et al. ..... 283/6 X 3,736,006 5/1973 Polsky ..... 283/6 X

FOREIGN PATENTS OR APPLICATIONS 950,508 10/1956 Germany ..... 283/6

768,040 9/1967 Canada ..... 283/6

*Primary Examiner*—Lawrence Charles

*Attorney, Agent, or Firm*—John J. Dennemeyer

[57] ABSTRACT

A lottery ticket which consists of a continuous strip of sheet material is perforated along predetermined lines and folded to provide a three-layer ticket in which the lottery number is placed on the bottom layer. The perforations are disposed in the two upper layers and define areas that can be readily broken to form lug portions. The ticket number on the bottom layer can be revealed only by pulling on the lug portions which will tear off along the perforated lines. In this manner the ticket is permanently and irreparably altered.

7 Claims, 5 Drawing Figures

Fig. 1
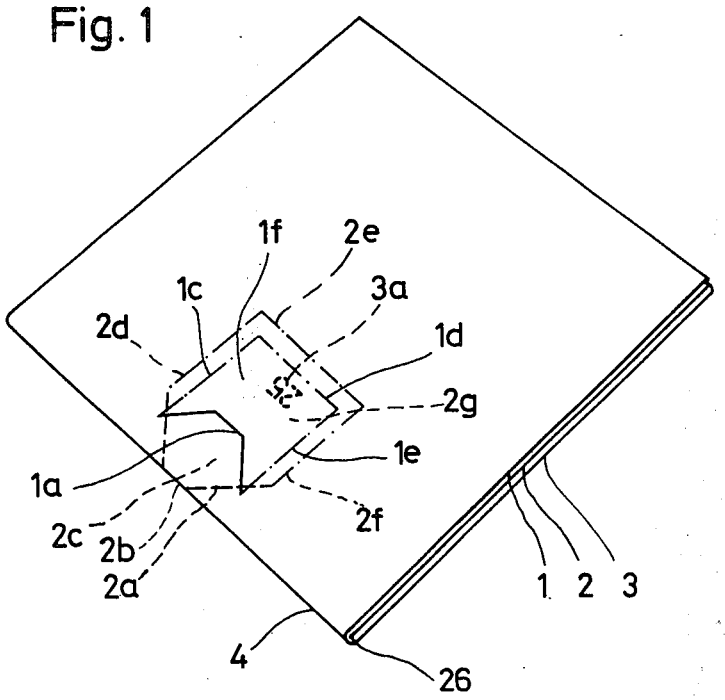
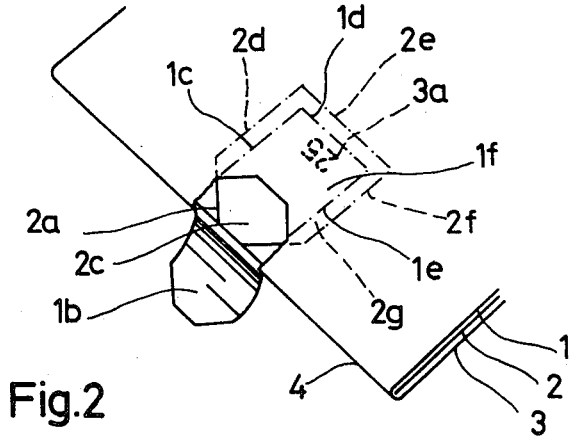
Fig.2

LOTTERY TICKET

The present invention relates to a lottery ticket made of laminar material and adapted to be opened by breaking at least one outer and at least one inner seal.

It is already known to provide lottery tickets with outer and inner seals to be broken in order to display the ticket number or designation. When using lottery tickets of this kind, there is the danger that the ticket number or designation could be read without any visible damage to the seals of the ticket. As a matter of fact, it has frequently been possible by unauthorized manipulation to lift up sealed portions of the ticket and in this way to acquire knowledge of the ticket number or designation, and then to restore the ticket into its non-broken condition without thereby causing any visible damage.

It is an object of the present invention to provide a lottery ticket of the kind mentioned above in which the ticket number and/or designation can only be revealed by a visible breaking of the seals of the ticket.

The lottery ticket according to the invention effectively prevents any reading of lottery-ticket numbers or designations, and any unauthorized breaking of the seals of the ticket will be clearly visible.

Figure 3:
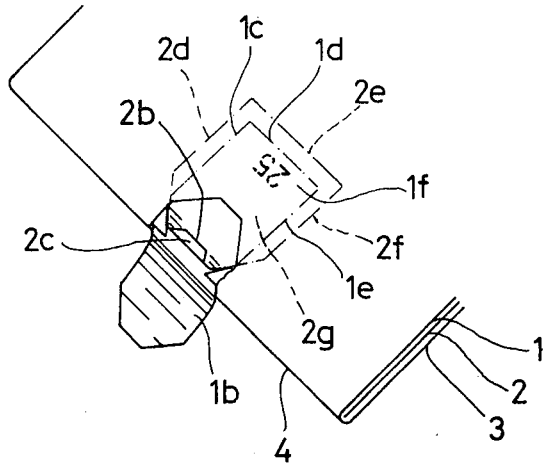
Figure 4:
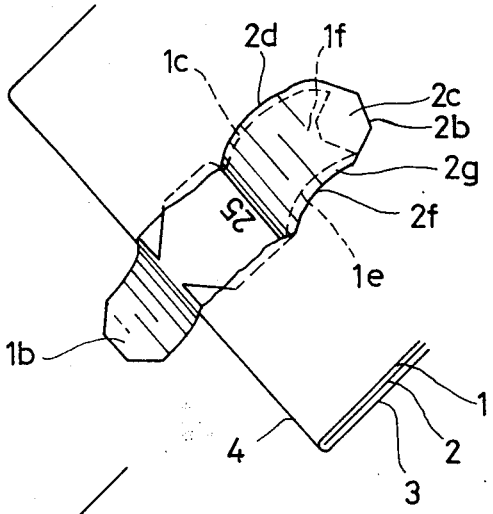
Figure 5:
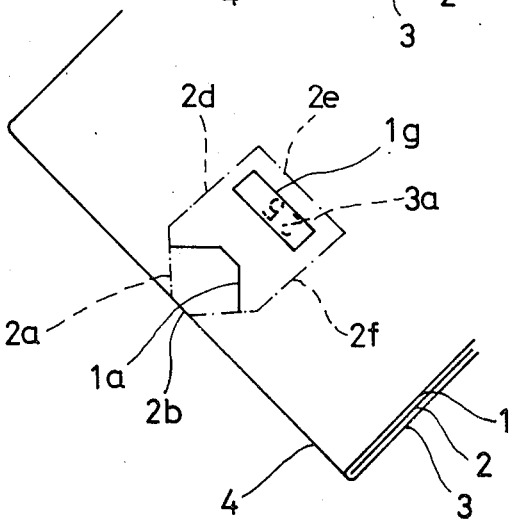

The invention will be described in greater detail hereinafter with reference to the accompanying drawings, in which:

FIG. 1 is a perspective view illustrating the lottery ticket of the invention in its sealed condition, FIG. 2 shows the lottery ticket with a first lug on the top leaf or top layer pulled up, FIG. 3 shows the lottery ticket with a lug of an intermediate leaf or layer folded upwardly, FIG. 4 shows the lottery ticket with a second lug of the top leaf or layer and the lug of the intermediate leaf or layer thereof pulled up to display the number of the lottery ticket, and FIG. 5 is a partial perspective view illustrating an alternative embodiment of the lottery ticket according to the invention.

According to one embodiment of the invention, the lottery ticket is made of a continuous rectangular strip of cardboard, paper or any other suitable material. The number or designation of the lottery ticket is placed on this strip and the ticket is provided with weakening or perforation lines so that it may be folded into a predetermined pattern or configuration. The strip is folded so as to result in a three-layer ticket, in which a top-layer or leaf 1 has perforation lines 1*a* to provide a finger-grip for the leaf in question, an intermediate layer or leaf 2 has perforation lines 2*a* to provide a finger-grip for this leaf, and a bottom-layer or leaf 3 has on its inner surface a ticket number 3*a* or a ticket designation.

In the embodiment illustrated by way of example, the perforation line 1*a*, is disposed in the vicinity of the folding line 4 between the top and bottom leaves. The perforation line is designed to form a lug which tapers away from the folding line 4 and which has a truncated end. By exerting pressure on the lug area the perforated line will break and provide a lug or tongue 1*b*. This lug can be gripped at its truncated extremity and pulled towards the folding line 4. In the embodiment shown in FIGS. 1 to 4, the top leaf 1, has additional weakening lines 1*c*, 1*d* and 1*e* defining a lug 1*f* the fourth side of which extends along the perforation 1*a*.

The perforation lines 2*a* of the intermediate leaf 2 define a lug 2*c* which tapers toward the end edge 2*b* of the intermediate leaf which is disposed immediately inwardly of folding line 4. This lug 2*c* has a truncated end formed by the end edge 2*b*. Leaf 2 further has weakening lines 2*d*, 2*e* and 2*f* which, together with the perforation lines 2*a*, define a lug 2*g*.

An essential requirement to prevent the above mentioned possibilities of manipulating the lottery ticket in an unauthorized manner resides in that the weakening lines 2*d*, 2*e* and 2*f* defining the lug 2*g* are disposed outside the weakening lines 1*c*, 1*d* and 1*e* defining lug 1*f*. This will in fact cause the lug 2*g* to be larger than lug 1*f* so that it will be impossible to lift the lugs so as to see the ticket number 3*a*. Such an intervention would involve an opening of the ticket that could be detected subsequently.

Outside of the portions defined by the weakening lines of lug 2*g*, and outside of the underside of lug 1*b*, the leafs 1, 2 and 3 are glued together or sealed to each other in any suitable way. In addition, lug 1*f* may be glued together with lug 2*g*.

As mentioned hereinbefore, the lottery ticket is initially opened by pulling up the lug 1*b*. In this way lug 2*c* can to be gripped, and lug 2*g* together with lug 1*f* glued thereto, can be pulled up and moved sideways so that the portions of the lug 2*g* disposed outside the weakening lines 1*c*, 1*d* and 1*f* will be pulled out. This will make visible the ticket number 3*a* on leaf 3, the seals of the lottery ticket being thereby visibly broken, as illustrated in FIG. 4.

As an alternative to the embodiment described by way of example hereinbefore, the top leaf 1 of the lottery ticket, instead of its lug 1*f*, may be provided with a window 1*g* (FIG. 5). In this case, the lug 2*g* of the intermediate leaf 2 is defined by weakening lines 2*d*, 2*e* and 2*f*, the weakening lines 2*d* and 2*f* being disposed outside the side edges of the window, and the weakening line 2*e* being disposed outside one longitudinal edge of the window, whereby the lug 2*g* will be larger in width than window 1*g*. This configuration makes it impossible to peel up the lug 2*g* to make visible the ticket number without causing visible damage to the lottery ticket. In this embodiment, lug 1*b* is pulled up in the manner described, after which lug 2*g* can be loosened from the intermediate leaf 2 and pulled outward until the ticket number 3*a* is visible in the window 1*g*. In this embodiment lug 2*g* is thus not glued to any portion of the top leaf 1, but except for the above-stated difference the lottery tickets described are similar in design.

It will be understood that a plurality of lug-type seals can be disposed beside each other on the lottery ticket, and one or more such seals may be disposed anywhere on the ticket without departing from the scope of the invention. Further, the lottery ticket may comprise three separate leaves which are glued together, although, from the point of view of production, it is advantageous to form the ticket from a strip which is folded into three layers or leafs. Finally, it may be mentioned that the lines defining the lugs or tongues can be formed, according to actual requirements, as continuous cuts, as dash cuts, as dot perforation lines or as weakening lines, and formed in a similar configuration or pattern.

What is claimed is:

1. A lottery ticket of laminar sheet material adapted to be opened by breaking at least one outer and at least one inner seal, the improvement consisting in that the ticket comprises a top leaf (1) provided with weakening or perforation lines (1*a*) disposed in spaced relation to the ticket edge to provide a finger-grip for tearing off a first lug (1*b*) thereof, an intermediate leaf (2) provided with weakening or perforation lines (2*a*) which provide a finger-grip for tearing off a lug (2*c*, 2*f*) after said lug (1*b*) of top leaf (1) has been torn off, said lug (2*c*, 2*f*) of the intermediate leaf being partially disposed beneath a lug (1*f*) or a window (1*g*) of the top leaf (1) and defined by weakening or perforation lines (2*d*, 2*e* and 2*f*) which, relative to the outer edges of the lottery ticket, are disposed outside weakening or perforation lines (1*c*, 1*d* and 1*e*) defining said second lug (1*f*) of the top leaf (1), or outside the edges defining the window (1*g*) formed in the top leaf, so that at least a portion of the lug (2*c*, 2*g*) of the intermediate leaf is larger than the lug (1*f*) on the window (1*g*) of the top leaf, said lottery ticket further comprising a bottom leaf (3) carrying a ticket number (3*a*) or other suitable designation so disposed as to be visible in the opening formed when the second lug (1*f*) of the top leaf and the lug (2*c*, 2*g*) of the intermediate leaf have been lifted off, or exposed in the window (1*g*) as the lug (2*c*, 2*g*) of the intermediate leaf has been pulled out from between the top and bottom leaves (1 and 3).

2. A lottery ticket according to claim 1 wherein a second lug (1*f*) is defined in the top leaf (1), said lug (1*f*) being sealed, preferably glued, to the lug (2*g*) of the intermediate leaf (2).

3. A lottery ticket according to claim 1 wherein the top leaf has a window (1*g*) formed therein, said window being disposed adjacent to and substantially in centered alignment with the perforation lines (1*a*) of the top leaf (1) and preferably having the same length or width as the area defined by said lines (1*a*).

4. A lottery ticket according to claim 3 wherein the perforation lines (1*a*) of the top leaf (1) define a tongue which tapers in a direction away from an adjacent side edge of the ticket and has a truncated end, and the perforation lines (2*a*) of the intermediate leaf (2) also define a tapered tongue which in part, at least, underlies the tongue of the top leaf and which tapers in a direction opposite to that of said last-mentioned tongue and which has also a truncated end.

5. A lottery ticket according to claim 4 comprising a strip which is folded over at two locations in a manner to cause two portions thereof on either side of one folding line (4) to form the top leaf and the bottom leaf (1 and 3) respectively and to cause a third portion thereof to lie between the latter leaves, thus forming the intermediate leaf (2).

6. A lottery ticket according to claim 5, wherein the perforation lines (1*a*) of the top leaf (1) are disposed adjacent said one folding line (4) and define a tongue which tapers in a direction away from the latter and has a truncated end, the perforation lines (2*a*) of the intermediate leaf (2) defining a tongue which in part at least, underlies the tongue of the top leaf (1), which tapers in a direction towards said folding line (4) and towards the end edge (2*b*) of the intermediate leaf (2), and has a truncated end, the truncated end edge being constituted by the end edge (2*b*) of the last-mentioned leaf (2).

7. A lottery ticket according to claim 6 wherein its leaves are sealed, preferably glued, to each other over the entire area outside the weakening lines (2*d*, 2*e* and 2*f*) defining the lug (2*g*) of the intermediate leaf (2).

* * * * *